US007701415B2

(12) United States Patent
Gotoda et al.

(10) Patent No.: US 7,701,415 B2
(45) Date of Patent: Apr. 20, 2010

(54) DISPLAY DEVICE

(75) Inventors: Akira Gotoda, Yamanashi-ken (JP); Tetsuya Shigeta, Yamanashi-ken (JP); Masahiro Suzuki, Yamanashi-ken (JP); Jun Kamiyamaguchi, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 1034 days.

(21) Appl. No.: 11/072,648

(22) Filed: Mar. 7, 2005

(65) Prior Publication Data

US 2005/0200571 A1 Sep. 15, 2005

(30) Foreign Application Priority Data

Mar. 9, 2004 (JP) ..... 2004-065578

(51) Int. Cl.
*G09G 3/28* (2006.01)

(52) U.S. Cl. ..... 345/63; 345/60; 345/89; 345/690

(58) Field of Classification Search ..... 345/60, 345/63, 41, 42, 76, 77, 89, 90, 690–693; 315/169.1–169.3
See application file for complete search history.

(56) References Cited

U.S. PATENT DOCUMENTS

| | | | | |
|---|---|---|---|---|
| 6,496,165 | B1 | 12/2002 | Ide et al. | |
| 6,496,194 | B1 * | 12/2002 | Mikoshiba et al. | 345/596 |
| 6,630,796 | B2 * | 10/2003 | Tokunaga et al. | 315/169.4 |
| 6,717,558 | B1 * | 4/2004 | Weitbruch et al. | 345/63 |
| 2002/0145575 | A1 | 10/2002 | Tong et al. | |
| 2003/0052841 | A1 | 3/2003 | Tanaka et al. | |
| 2005/0057581 | A1 * | 3/2005 | Horiuchi et al. | 345/690 |
| 2005/0156826 | A1 * | 7/2005 | Choi | 345/60 |

FOREIGN PATENT DOCUMENTS

| | | |
|---|---|---|
| EP | 0 888 004 | 12/1998 |
| JP | 2-39092 | 2/1990 |
| JP | 02-091687 | * 3/1990 |
| JP | 5-35205 | 2/1993 |
| JP | 8-32903 | 2/1996 |
| JP | 8-160912 | 6/1996 |
| JP | 9-34403 | 2/1997 |
| JP | 9-38945 | 2/1997 |
| JP | 9-68945 | 3/1997 |
| JP | 2000-122606 | 4/2000 |
| JP | 2000-172226 | 6/2000 |
| JP | 2001-067041 | 3/2001 |
| JP | 2001-83929 | 3/2001 |
| JP | 2003-280590 | 10/2003 |
| JP | 2005-128542 | 5/2005 |
| JP | 2005-2024409 | 7/2005 |

* cited by examiner

*Primary Examiner*—Richard Hjerpe
*Assistant Examiner*—Jennifer T Nguyen
(74) *Attorney, Agent, or Firm*—Drinker Biddle & Reath LLP

(57) ABSTRACT

The object is to provide a display device in which high-quality image display that is free from luminance nonuniformity can be obtained with a simplified structure.

A magnitude of load corresponding to the light emission state of each pixel cell on a display line is measured for each display line based on a video signal, and correction of the luminance level according to the magnitude of load corresponding to the display line is conducted for the interval of the video signal corresponding to each display line.

2 Claims, 5 Drawing Sheets

FIG. 5

| | GD1 | GD2 | GD3 | GD4 | GD5 | GD6 | ..... | GDm-2 | GDm-1 | GDm | |
|---|---|---|---|---|---|---|---|---|---|---|---|
| FIRST BIT B1 | 1 | 0 | 0 | 1 | 1 | 0 | ..... | 0 | 1 | 0 | ⇨ SF1 |
| SECOND BIT B2 | 1 | 0 | 0 | 0 | 1 | 1 | ..... | 1 | 0 | 0 | ⇨ SF2 |
| THIRD BIT B3 | 1 | 0 | 0 | 0 | 1 | 0 | ..... | 1 | 1 | 0 | ⇨ SF3 |
| FOURTH BIT B4 | 0 | 1 | 1 | 1 | 0 | 1 | ..... | 0 | 0 | 1 | ⇨ SF4 |
| ..... | | | | | | ..... | | | | | ..... |
| THIRTEENTH BIT B13 | 1 | 1 | 0 | 1 | 1 | 0 | ..... | 1 | 0 | 0 | ⇨ SF13 |
| FOURTEENTH BIT B14 | 0 | 1 | 0 | 0 | 0 | 0 | ..... | 0 | 1 | 1 | ⇨ SF14 |
| FIFTEENTH BIT B15 | 0 | 0 | 0 | 0 | 0 | 0 | ..... | 0 | 1 | 1 | ⇨ SF15 |

DISPLAY DEVICE

BACKGROUND OF THE INVENTION

1. Field of the Invention

The present invention relates to a display device equipped with a display panel.

2. Description of the Related Art

A plasma display device having a plasma display panel (referred to hereinbelow as "PDP") as thin color display panel of a large surface area are presently at a stage of manufactured products.

In PDP, a front glass substrate serving as a display surface and a rear substrate are disposed opposite each other via a discharge space enclosing a discharge gas. A plurality of stripe-like row electrodes extending in the row direction on the display surface are formed on the inner surface (surface facing the rear substrate) of the front glass substrate. On the other hand, a plurality of stripe-like column electrodes extending in the column direction on the display surface are formed on the rear substrate. In this case, a pair of adjacent row electrodes (referred to hereinbelow as "row electrode pair") serve as one display line. Thus, a structure is obtained in which discharge cells serving as pixels are formed in the intersections of each row electrode pair and column electrodes.

In plasma display devices, first, a wall charge is selectively formed inside each discharge cell according to pixel data of each pixel. Then, a sustaining pulse is repeatedly applied to the row electrodes of the PDP, thereby inducing a repeated sustained discharge in discharge cells where the wall charge has been formed and sustaining the light emission state following this discharge.

Here, following the sustained discharge, a sustained discharge current flows in each row electrode. Further, as the screen size of the PDP increases, the length of row electrodes also increases and the resistance thereof rises. Therefore, a comparatively large voltage drop occurs when the sustained discharge current flows in the row electrodes. At this time, each row electrode has different quantity of sustained discharge current and voltage drop, the difference depending on the total number of discharge cells where the sustained discharge has been initiated on the row electrode. Thus, in the display lines with a large number of discharge cells where the sustained discharge has been initiated, the voltage drop is larger than in the display lines with a small number of such discharge cells. Therefore, the light emission luminance following the sustained discharge decreases. The resultant problem is that luminance nonuniformity occurs within one screen.

In order to resolve this problem, an image display device was suggested in which the number of sustaining pulses that had to be applied to a display was changed for each display line based on display data (for example, JP-A-09-38945).

However, complex control is required to change the number of sustaining pulses for each display line, and the adjustment and verification operations necessary therefor are also difficult.

It is an object of the present invention to provide a display device that resolves the above-described problems and in which high-quality image display without luminance nonuniformity can be attained with a simplified configuration.

SUMMARY OF THE INVENTION

The display device according to an aspect of the invention comprises a display panel having formed therein a plurality of pixel cells corresponding to pixels on each of a plurality of display lines and light emission drive portion for causing each pixel cell to emit light by applying a drive pulse to each display line according to a video signal, this display device having load magnitude measurement portion for measuring for each display line a magnitude of load corresponding to the light emission state of each pixel cell on one display line based on the video signal and correction portion for conducting the correction of luminance level according to the magnitude of load corresponding to the display line with respect to an interval of the video signal that corresponds to each display line.

The display device according to another aspect of the invention comprises a display panel having formed therein a plurality of pixel cells corresponding to pixels on each of a plurality of display lines and light emission drive portion for causing each pixel cell to emit light by applying a drive pulse to each display line according to a video signal, this display device having load magnitude measurement portion for measuring for each pixel cell a magnitude of load corresponding to the light emission state of each pixel cell based on the video signal and correction portion for conducting the correction of luminance level according to the magnitude of load corresponding to the pixel cell with respect to an interval of the video signal that corresponds to each display line.

The display device according to another aspect of the invention comprises a display panel having formed therein a plurality of pixel cells corresponding to pixels on each of a plurality of display lines and light emission drive portion for causing each pixel cell to emit light by applying a drive pulse to each display line according to a video signal, this display device having load magnitude measurement portion for measuring a magnitude of load corresponding to the light emission state of each pixel cell based on the video signal and correction portion for correcting a luminance level in the video signal according to the magnitude of load when an on-screen image signal is superimposed on the video signal or when the video signal is a computer video signal.

BRIEF DESCRIPTION OF THE DRAWINGS

FIG. 5 shows an example of the first bit B1 to fifteenth bit B15 of each pixel drive data $GDD_1$-$GDD_m$.

DETAILED DESCRIPTION OF THE INVENTION

Figure 1:
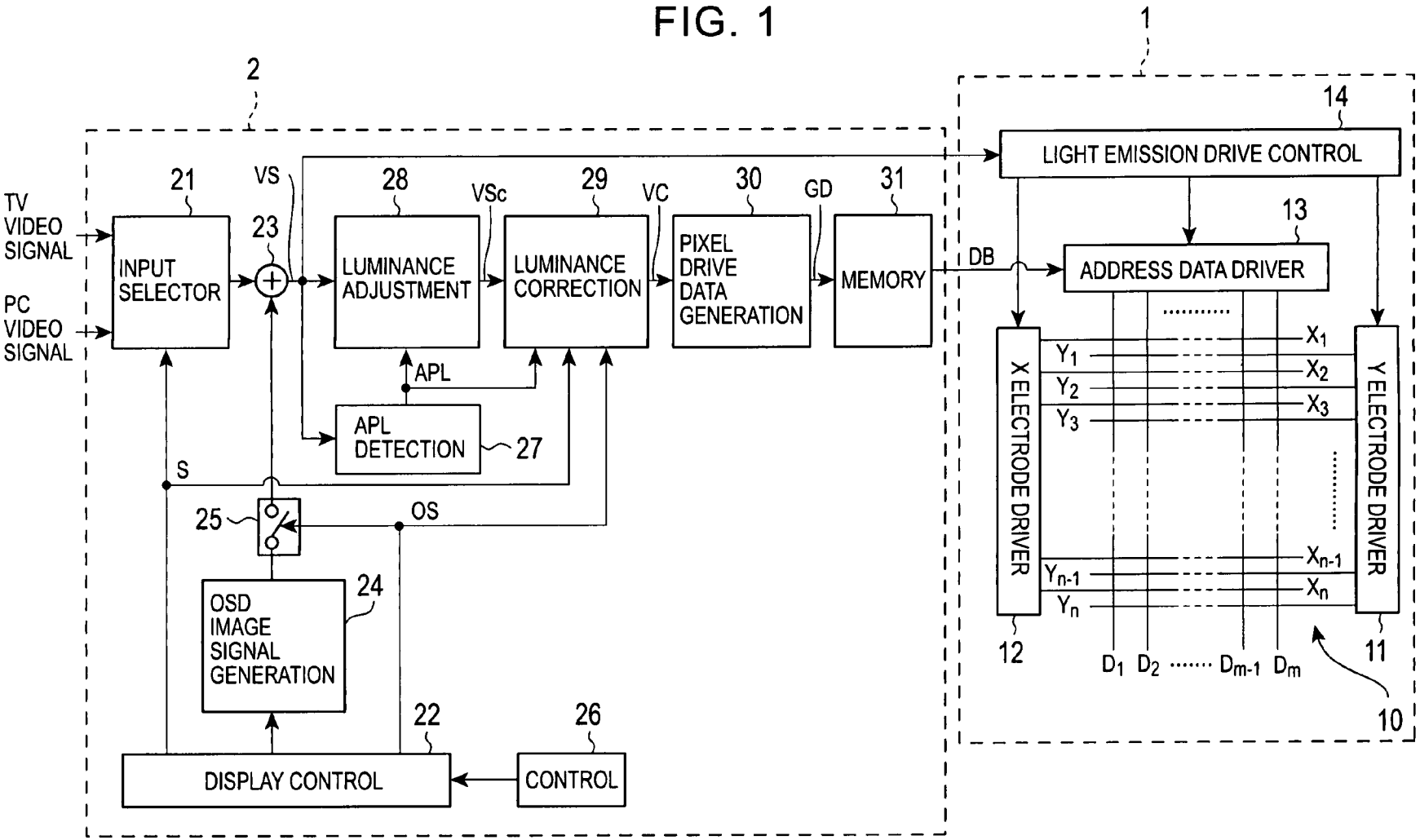
FIG. 1 illustrates the configuration of a plasma display device as a display device in accordance with the present invention.

FIG. 1 illustrates the configuration of a plasma display device as a display device in accordance with the present invention.

As shown in FIG. 1, the plasma display device comprises a display unit 1 and a video signal processing unit 2. The display unit 1 comprises a PDP 10 as a plasma display panel, an X electrode driver 11, an Y electrode driver 12, an address data driver 13, and a light emission drive control circuit 14.

Column electrodes $D_i$-$D_m$ extending in the vertical direction in the display screen are formed in the PDP 10. Further, row electrodes $X_1$-$X_n$ and row electrodes $Y_1$-$Y_n$ extending in the horizontal direction of the display screen are also formed with an X-Y alternating configuration in the PDP 10. In this case, the row electrode pairs ($Y_1$, $X_1$), ($Y_2$-$X_2$), ($Y_3$, $X_3$), . . . ($Y_n$, $X_n$), in which two adjacent electrodes form a pair, correspond to respective first display line to n-th display line in the PDP 10. A pixel cell PC is formed in the intersections of each display line and each column electrode $D_1$-$D_m$. Thus, in the PDP 10, the pixel cells $PC_{1,1}$ to $PC_{1,m}$ that belong to the first display line, the pixel cells $PC_{2,1}$ to $PC_{2,m}$ that belong to the second display line, . . . , and the pixel cells $PC_{n,1}$ to $PC_{n,m}$ that belong to the n-th display line are arranged as a matrix.

Figure 2:
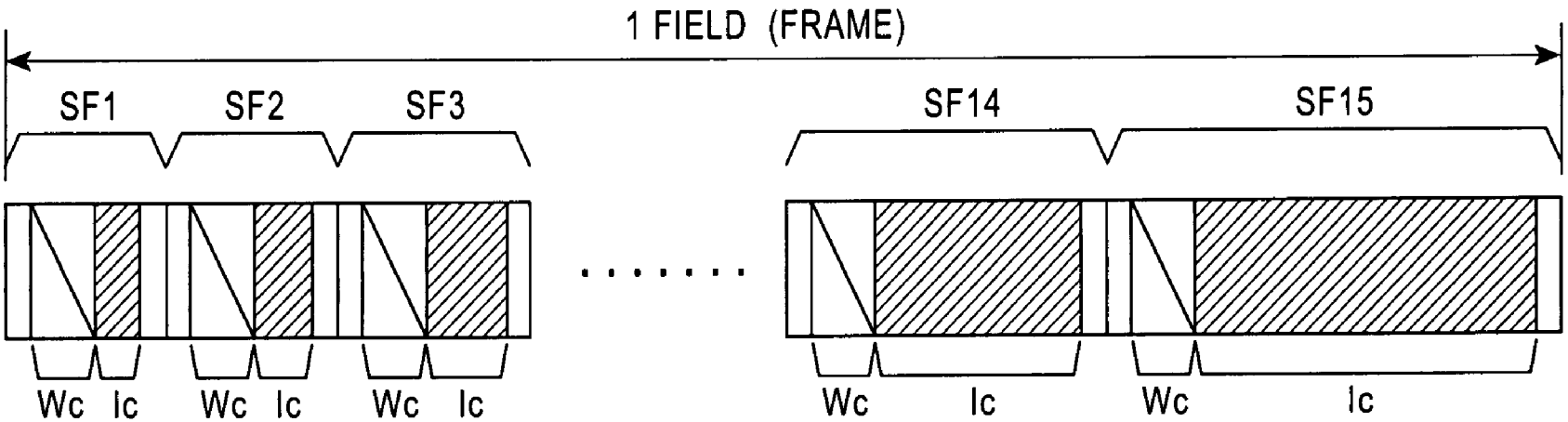
FIG. 2 illustrates an example of a light emission drive sequence relating to driving the PDP 10 shown in FIG. 1 based on a sub-field method.

A light emission drive control circuit 14 controls the X electrode driver 11, Y electrode driver 12, and address data driver 13 so as to light emission drive the PDP 10 according to the light emission drive sequence employing a sub-field method, for example, as shown in FIG. 2. In the light emission drive sequence shown in FIG. 2, each field (or frame) of a video signal comprises 15 sub-fields SF1-SF15 each comprising an address step Wc and a light emission sustained step Ic.

In the address step Wc of each sub-field SF1-SF15, the Y electrode driver 12 successively applies a scanning pulse SP to row electrodes $Y_1$ through $Y_n$. Within this period, the address data driver 13 applies to the column electrodes $D_1$-$D_m$ of the PDP 10 the respective m pixel data pulses $DP_1$-$DP_m$ having a voltage corresponding to respective pixel drive data bits of one display line supplied from the memory 31. Such an operation sets each pixel cell $PC_{1,1}$ to $PC_{n,m}$ of the PDP 10 into either a light emission mode in which light is emitted in the light emission sustained step Ic or a quenching mode in which a quenched state is assumed in the light emission sustained step Ic, according to the pixel drive data bit DB.

Further, in the light emission sustained steps Ic of sub-fields SF1-SF15, the X electrode driver 11 applies to each row electrode $X_1$-$X_n$ of the PDP 10 a sustaining pulse with the repetition frequency corresponding to the weight of the sub-field SF. Furthermore, in the light emission sustained steps Ic of sub-fields SF1-SF15, the Y electrode driver 12 applies to each row electrode $Y_1$-$Y_n$ of the PDP 10 a sustaining pulse with the repetition frequency corresponding to the weight of the sub-field. As a result of such operations, among the pixel cells $PC_{1,1}$ to $PC_{n,m}$ of the PDP 10, only the pixel cells PC that have been set into the aforementioned light emission mode are discharged (sustained discharge) each time the sustaining pulse is applied, and the light emission state accompanying this discharge is sustained.

As a result of the above-described operations, a medium luminance corresponding to a total number of sustained discharges of pixel cells PC is viewed in the light emission sustained step of each sub-field SF1-SF15.

Further, referring to FIG. 1, the video image processing unit 2 comprises an input selector 21, a display control circuit 22, an adder 23, an OSD (On Screen Display) image signal generation circuit 24, a switch 25, an operation unit 26, an APL detection circuit 27, a luminance adjustment circuit 28, a luminance correction circuit 29, a pixel drive data generation circuit 30, and a memory 31.

The input selector 21 selects either the inputted television video signal (referred to hereinbelow as "TV video signal") or the inputted computer video signal (referred to hereinbelow as "PC video signal") according to the selection signal supplied from the display control circuit 22 and supplies the selected signal to the adder 23. The OSD image signal generation circuit 24 generates an OSD image signal (on screen image signal) corresponding to the control image designated in the display control circuit 22 and supplies the generated signal to the switch 25. The switch 25 is switched ON when the OSD image display command signal OS is supplied from the display control circuit 22 and supplies this OSD image signal to the adder 23. The adder 23 adds the OSD image signal supplied from the switch 25 to the video signal (TV video signal or PC video signal) supplied from the input selector 21 and supplies the obtained video signal VS to the light emission drive control circuit 14, APL detection circuit 27, and luminance adjustment circuit 28.

The operation unit 26 receives the operation instructions from the user and generates various command signals corresponding to those operations. For example, if the user executes the operation so as to display a television video, the operation unit 26 supplies a television video display command signal to the display control circuit 22. At this time, the display control circuit 22 supplies to the input selector 21 the selection signal S for selecting the TV video signals. Further, if the user executes the operation so as to display a computer video, the operation unit 26 supplies a computer video display command signal to the display control circuit 22. At this time, the display control circuit 22 supplies to the input selector 21 the selection signal S for selecting the computer video signals. Further, for example, if the user presses a screen size switching control key (not shown in the figure), the operation unit 26 supplies to the display control circuit 22 a command requesting the generation of an OSD image signal for screen size switching control and supplies the OSD image display command signal OS to the switch 25. As a result, the adder 23 superimposes, for example, the OSD image signal for screen size switching control on the video signal (TV video signal or PC video signal) selected by the input selector 21 and outputs the obtained video signal VS. If the user conducted no command operation requesting the display of OSD images, the switch 25 assumes an OFF state. At this time, the adder 23 directly outputs the video signal selected by the input selector 21 as the Video signal VS. The APL detection circuit 27 finds an average luminance level in this video signal VS for each one field (frame) and supplies it as the average luminance level APL to the luminance adjustment circuit 28. The luminance adjustment circuit 28 executes with respect to this video signal VS the adjustment so as to reduce the luminance level of the video signal VS at a reduction rate increasing with the increase in the average luminance level APL and supplies the luminance-adjusted video signal VSc thus obtained to the luminance correction circuit 29.

The luminance correction circuit 29 conducts the correction processing (described hereinbelow) of the luminance level with respect to the luminance-adjusted video signal VSc so as to correct the luminance nonuniformity resulting from the fact that the magnitude of load corresponding to the total number of pixel cells assuming the light emission state in one display line is different for each pixel line and supplies the luminance-corrected video signal VC thus obtained to the pixel drive data generation circuit 30.

The pixel drive data generation circuit 30 generates pixel drive data $GD_{1,1}$-$GD_{n,m}$ designating whether to set the pixel cells $PC_{1,1}$-$PC_{n,m}$ into a light emission mode or a quenching mode in the address step Wc of each sub-field SF1-SF15 shown in FIG. 2 based on the luminance-corrected video signal VC and supplies those data to the memory 31. Each of the pixel drive data $GD_{1,1}$-$GD_{n,m}$ comprises 15 bits corresponding to sub-fields SF1-SF15. For example, when the first bit of the pixel drive data $GD_{1,1}$ corresponding to the pixel cell $PC_{1,1}$ is a logical level 1, the pixel cell $PC_{1,1}$ is set to the light emission mode in the address step Wc of the sub-field SF1. On the other hand, when the first bit of the pixel drive data $GD_{1,1}$ is a logical level 0, the pixel cell $PC_{1,1}$ is set to the quenching mode in the address step Wc of the sub-field SF1. Further, when the fifteenth bit of the pixel drive data $GD_{1,1}$ is a logical level 1, the pixel cell $PC_{1,1}$ is set to the light emission mode in the address step Wc of the sub-field SF15, but when this fifteenth bit is a logical level 0, the pixel cell $PC_{1,1}$ is set to the quenching mode in the address step Wc of the sub-field SF15.

The memory 31 stores the pixel drive data $GD_{1,1}$-$GD_{n,m}$ supplied from the pixel drive data generation circuit 30 and reads them separately for the columns with identical bits. Thus, the memory 31 reads the pixel drive data GD for each stored pixel cell PC as pixel drive data bits DB1-DB15 as follows:

DB1: first bit of pixel drive data GD.
DB2: second bit of pixel drive data GD.
DB3: third bit of pixel drive data GD.
DB4: fourth bit of pixel drive data GD.
DB5: fifth bit of pixel drive data GD.
DB6: sixth bit of pixel drive data GD.
DB7: seventh bit of pixel drive data GD.
DB8: eighth bit of pixel drive data GD.
DB9: ninth bit of pixel drive data GD.
DB10: tenth bit of pixel drive data GD.
DB11: eleventh bit of pixel drive data GD.
DB12: twelfth bit of pixel drive data GD.
DB13: thirteenth bit of pixel drive data GD.
DB14: fourteenth bit of pixel drive data GD.
DB15: fifteenth bit of pixel drive data GD.

In this process, the memory 31 reads the pixel drive data bits during execution of the address steps Wc of respective sub-fields as follows:

pixel drive data bit DB1-sub-field SF1,
pixel drive data bit DB2-sub-field SF2,
pixel drive data bit DB3-sub-field SF3,
pixel drive data bit DB4-sub-field SF4,
pixel drive data bit DB5-sub-field SF5,
pixel drive data bit DB6-sub-field SF6,
pixel drive data bit DB7-sub-field SF7,
pixel drive data bit DB8-sub-field SF8,
pixel drive data bit DB9-sub-field SF9,
pixel drive data bit DB10-sub-field SF10,
pixel drive data bit DB11-sub-field SF11,
pixel drive data bit DB12-sub-field SF12,
pixel drive data bit DB13-sub-field SF13,
pixel drive data bit DB14-sub-field SF14,
pixel drive data bit DB15-sub-field SF15, and supplies the bits to the address data driver 13.

The luminance correction processing conducted with the luminance correction circuit 29 shown in FIG. 1 will be explained below.

Figure 3:
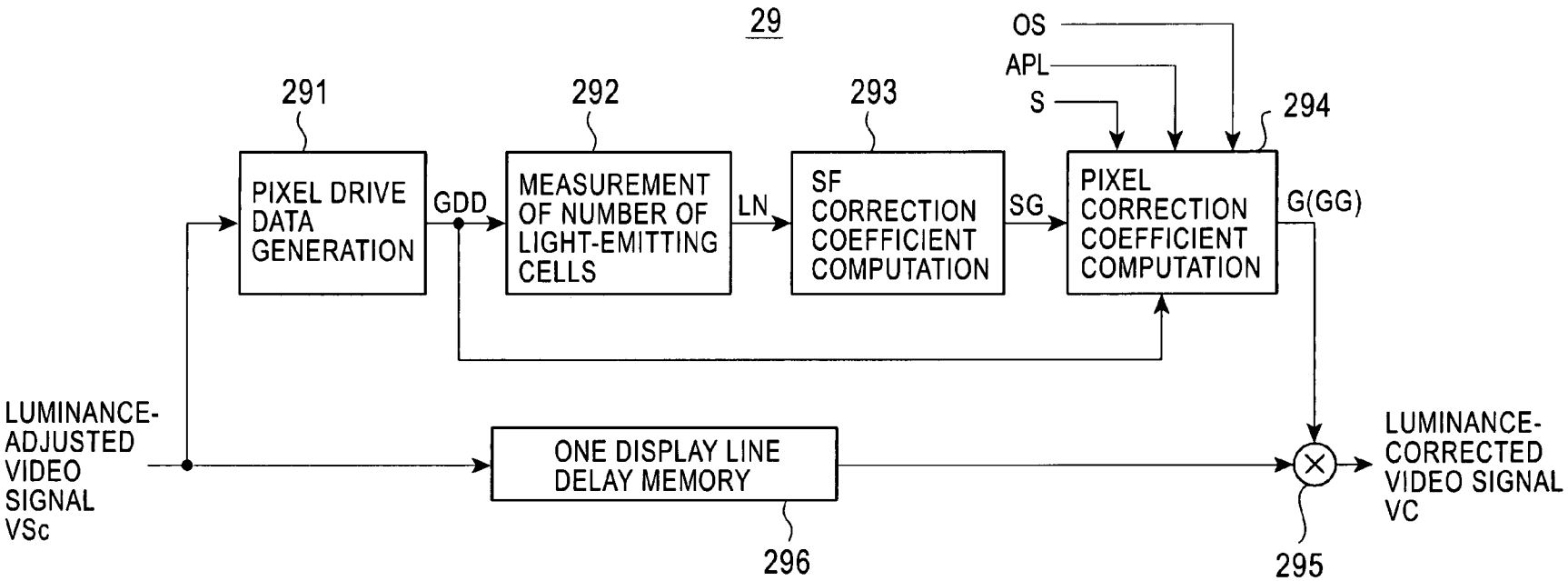
FIG. 3 shows an example of the internal configuration of the luminance correction circuit 29 shown in FIG. 1.

FIG. 3 shows the inner configuration of the luminance correction circuit 29.

Referring to FIG. 3, a pixel drive data generation circuit 291, first, converts the afore-mentioned luminance-adjusted video signal VSc into pixel data $PD_1$-$PD_m$ corresponding to each of m pixels located in a display line for each one display line. Then, the pixel drive data generation circuit 291 generates pixel drive data $GDD_1$-$GDD_m$ each composed of 15 bits for designating the setting state (light emission or quenching mode) of a pixel cell PC in the address steps Wc of corresponding sub-fields SF1-SF15 based on the pixel data $PD_1$-$PD_m$. For example, when the first bit of the pixel drive data $GDD_1$ corresponding to the first display line is a logical level 1, the pixel cell $PC_{1,1}$ is set to the light emission mode in the address step Wc of the sub-field SF1. On the other hand, when the first bit of the pixel drive data $GDD_1$ is a logical level 0, the pixel cell $PC_{1,1}$ is set to a quenching mode in the address step Wc of the sub-field SF1. Further, when the third bit of the pixel drive data $GDD_2$ corresponding to the first display line is a logical level 1, the pixel cell $PC_{1,2}$ is set to a light emission mode in the address step Wc of the sub-field SF3.

A light-emitting cell number measurement circuit 292 finds as a light-emitting cell number LN the number of pixel cells PC that will be set to the light emission mode for each sub-field SF1-SF15 based on the pixel drive data $GDD_1$-$GDD_m$ for one display line. Further, the light-emitting cell number measurement circuit 292 supplies the light-emitting cell numbers LN1-LN15 relating to each sub-field SF1-SF15 to a SF correction coefficient computation circuit 293.

The SF correction coefficient computation circuit 293 finds the SF correction coefficients SG1-SG15 corresponding to each sub-field SF1-SF15 by the following formula and supplies the SF correction coefficients to a pixel correction coefficient computation circuit 294.

$$SG=1-\alpha\cdot[(m-LN)/m]^2,$$

where α: prescribed coefficient;

m: total number of pixel cells PC belonging to one display line;

LN: number of light-emitting cells in one display line.

The pixel correction coefficient computation circuit 294 computes the pixel correction coefficients $G_1$-$G_m$ $$G_Q = [(SG1\cdot K1\cdot B1_Q)+(SG2\cdot K2\cdot B2_Q)+(SG3\cdot K3\cdot B3_Q)+, \ldots, +(SG15\cdot K15\cdot B15_Q)]/[(K1\cdot B1_Q)+(K2\cdot B2_Q)+(K3\cdot B3_Q)+, \ldots, (K15\cdot B15_Q)] \quad \text{(Eq. 1)}$$

Q: 1, 2, 3, . . . , m.

corresponding to each of m pixels of one display line based on the SF correction coefficients SG1-SG15 the number of light emission cycles K1-K15 in the light emission sustained step Ic of each sub-field SF1-SF15, and the first bit B1 through fifteenth bit B15 of the pixel drive data $GDD_1$-$GDD_m$.

A one display line delay memory 296 delays by one display line the luminance-adjusted video signals supplied from the luminance adjustment circuit 28 and then successively sends them to a multiplier 295. The multiplier 295 successively multiplies the pixel correction coefficients $G_1, G_2, G_3, \ldots G_m$ by the luminance level indicated by the luminance-adjusted video signals VSc successively supplied from the one display line delay memory 296 and outputs the multiplication results as luminance-corrected video signals VC. Thus, the multiplier 295 conducts the correction of the luminance level by successively multiplying the pixel correction coefficients $G_1$, $G_2, G_3, \ldots G_m$ corresponding to the pixel with respect to the intervals corresponding to each pixel in the luminance-adjusted video signals VSc.

As described hereinabove, in the luminance correction circuit 29, first, SF correction coefficients SG1-SG15 corresponding to the number of pixel cell PC that are set in the light emission mode within each display line are found for each sub-field SF1-SF15. Then, weighting addition is executed by adding a weight determined by the number of light emission cycles K1-K15 of each sub-field with respect to each SF correction coefficient SG1-SG15 as shown by the numerator term of the equation Eq.1. At this time, the SF correction coefficient SG that is the object of weighting addition is determined for each pixel based on the pixel drive data GDD (B1-B15) corresponding to the pixel. Thus, only when the bit of the pixel drive data GDD is of a logical level 1 that sets the pixel cell PC into a light emission mode, the SF correction coefficient SF of the sub-field SF corresponding to this bit position becomes the object of weighting addition. In other words, the SF correction coefficient SG of the sub-field SF corresponding to the bit position with a logical level 0 that sets the pixel cell into the quenching mode is outside the range of objects of the above-described weighting addition. Further, the luminance correction circuit 29 finds the pixel correction coefficient G of each pixel by dividing the weighting addition results by the total number of light emission cycles within one field based on the pixel drive data GDD, as shown by the equation Eq.1 above.

For example, when the first bit Bl through third bit B3 of the pixel drive data GDD are a logical level 1 and the fourth bit B4 through fifteenth bit B15 are logical level 0, only the SF correction coefficients SG1-SG3 corresponding to SF1-SF3, respectively, are the objects of the above-described weighting addition. Furthermore, at this time, because light emission of the pixel cell PC is implemented only in the light emission sustained step Ic of respective SF1-SF3 within one field, the total number of light emission cycles will be K1+K2+K3. Therefore, the pixel correction coefficient G obtained at this time is $$G=[(SG1\cdot K1)+(SG2-K2)+(SG3\cdot K3)]/[(K1+K2+K3]$$

Further, the luminance correction circuit 29 generates a luminance-corrected video signal VC, which was subjected to luminance correction, by multiplying the luminance-adjusted video signal VSc by the pixel correction coefficient G of each pixel.

Here, when the m pixel cells PC located in each display line are all set to a light emission mode over the sub-fields SF1-SF15, all the numbers of light-emitting cells LN1-LN15 will be m. As a result, all the SF correction coefficients SG1-SG15 become 1 and the pixel correction coefficient G becomes 1. Thus, when all the m pixel cells PC located in each display line are set to a light emission mode over the sub-fields SF1-SF15, that is, when the magnitude of load is maximum, the luminance-adjusted video signal VSc is outputted, without changes, as the luminance-corrected video signal VC. On the other hand, when there are pixel cells PC that are set into a quenching mode in each display line, the SF correction coefficient SG decreases by the respective number and the pixel correction coefficient G becomes small (1 or less).

Thus, in the luminance correction circuit 29, the magnitude of load of each display line is found by measuring the number of pixel cells PC assuming the light emission state (or quenching state), and the luminance level of the luminance-adjusted video signal VSc corresponding to each pixel cell belonging to the display line is corrected according to this magnitude of load. At this time, as the number pf pixel cell PC assuming the light emission state in each display line decreases, the current consumption in the display lines decreases and the voltage drop also decreases. Therefore, as the number of pixel cells PC assuming the light emission state (on each display line) decreases, the correction is conducted that has to reduce the luminance level of the luminance-adjusted video signal VSc. Such a correction reduces the difference in luminance of the pixel cells between a display line where the voltage drop increases because of a large number of pixel cells assuming the light emission state and a display line where the voltage drop is small due to a small number of pixel cells assuming the light emission state.

Therefore, with the luminance correction circuit 29 shown in FIG. 3, the difference in luminance between the display lines can be reduced without conducting a complex control such as changing for each display line the number of sustaining pulses that have to be applied to the PDP 10.

Further, in the above-described embodiment, the luminance correction circuit 29 conducted the luminance correction by taking as a reference (pixel correction coefficient G=1) the case where all the pixel cells PC on one display line were in the light emission state, but the luminance correction may be also conducted by taking as a reference the case where all the pixel cells PC on one display line are in the quenching state.

Thus, in this case, the SF correction coefficient computation circuit 293 of the luminance correction circuit 29 finds the SF correction coefficients SG1-SG15 corresponding to each one sub-field SF1-SF15 by the following formula.

$$SG=1+\alpha\cdot[LN/m]^2,$$

where α: prescribed coefficient;

m: total number of pixel cells PC on one display line;

LN: number of light-emitting cells in one display line.

As a result, when the m pixel cells PC located in each display line are all set to a quenching mode over the sub-fields SF1-SF15, all the numbers LN1-LN15 of light-emitting cells will be zero. As a result, all the SF correction coefficients SG1-SG15 become 1 and the pixel correction coefficient G becomes 1. Thus, when all the m pixel cells PC located in each display line are set to a quenching mode over the sub-fields SF1-SF15, that is, when the magnitude of load is minimum, the luminance-adjusted video signal VSc is outputted, without changes, as the luminance-corrected video signal VC. On the other hand, when there are pixel cells PC that are set into the light emission mode in each display line, the SF correction coefficient SG decreases by the respective number and the pixel correction coefficient G becomes large (1 or more). In other words, as the number of pixel cells PC assuming the light emission state in each display line increases, the luminance correction circuit 29 conducts the correction so as to increase the luminance level of the luminance-adjusted video signal VSc.

With such a correction, too, it is possible to reduce the difference in luminance of the pixel cells between a display line where the voltage drop increases because of a large number of pixel cells PC assuming the light emission state and a display line where the voltage drop is small due to a small number of pixel cells PC assuming the light emission state.

Here, when the so-called dark image with a low average luminance level in one screen is displayed, the difference in luminance between the display lines is less noticeable than in the case where a bright image is displayed.

Accordingly, in the luminance correction circuit 29, when the average luminance level within one screen, that is, the average luminance level APL detected by the APL detection circuit 27, is lower than the prescribed level, the correction quantity relating to the luminance-adjusted video signal VSc may be decreased by comparison with the case where the average luminance level within one screen is higher than the prescribed level. At this time, when the average luminance level APL is equal to or less than the prescribed value, the pixel correction coefficient computation circuit 294 supplies to the multiplier 295 a pixel correction coefficient GG in which the correction quantity relating to the luminance-adjusted video signal VSc was reduced by conducting computation, for example, by the below-described formula, with respect to the pixel correction coefficient G, instead of the pixel correction coefficient G found by the above-described equation Eq.1.

$$GG=P\cdot G+Q$$

$$1=P+Q$$

P, Q are positive numbers.

Further, when the average luminance level APL is equal to or less than the prescribed value, the pixel correction coefficient computation circuit 294 may fixedly supply "1" at which the correction quantity is 0 to the multiplier 295, instead of the pixel correction coefficient G found by the above-described equation Eq.1.

Similarly, when the input video signal is a moving picture signal representing a moving picture, as a TV video signal, the difference in luminance between the display lines is less noticeable than in the case where an OSD image is displayed with superposition on the input video signal, or the case where the input video signal is a PC video signal.

Accordingly, when the OSD image display command signal OS is not supplied or when the selection signal S selects a TV video signal, the pixel correction coefficient computation circuit 294 supplies to the multiplier 295 the pixel correction coefficient GG, in which the correction quantity relating to the luminance-adjusted video signal VSc is less than that in the pixel correction coefficient G, instead of the pixel correction coefficient G found by the above-described equation Eq.1.

Further, when the OSD image display command signal OS is not supplied or when the selection signal S selects a TV video signal, the pixel correction coefficient computation circuit 294 may fixedly supply "1" at which the correction quantity is 0 to the multiplier 295, instead of the pixel correction coefficient G found by the above-described equation Eq.1.

As described hereinabove, in the luminance correction circuit 29 shown in FIG. 3, the magnitude of load is measured for each display line based on the light emission state of each pixel cell on a display line, and the correction of the luminance level according to the magnitude of load corresponding to this display line is conducted with respect to the interval in the video signal that corresponds to each display line.

In each display line, too, the difference in luminance sometimes occurs depending on the mutual arrangement of the pixel cells PC assuming the light emission state. For example, the light emission luminance decreases in the pixel cells PC positioned at the left or right end with respect to the central portion of the display line.

Figure 4:
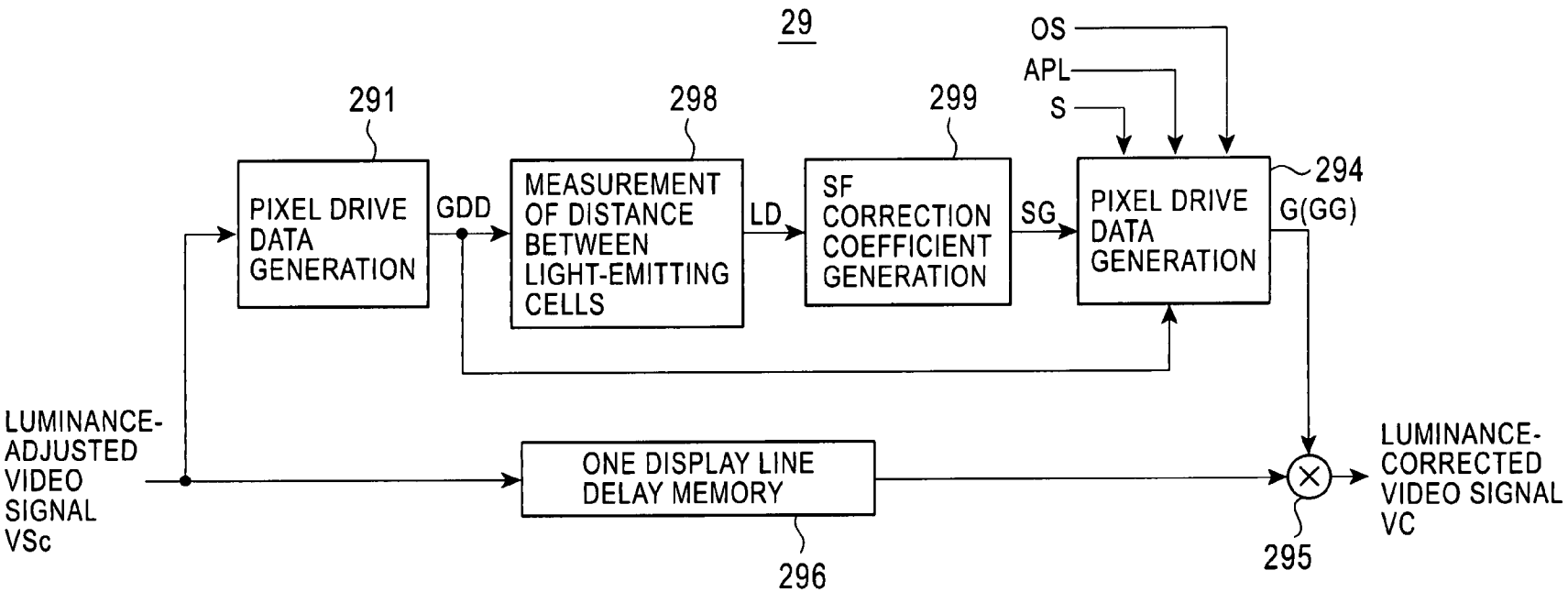
FIG. 4 illustrates another configuration of the luminance correction circuit 29.

FIG. 4 shows another internal configuration of the luminance correction circuit 29 provided in view of this issue.

In the luminance correction circuit 29 shown in FIG. 4, a circuit 298 for measuring the distance between light-emitting cells and a SF correction coefficient generation circuit 299 are used instead of the light-emitting cell number measurement circuit 292 and SF correction coefficient computation circuit 293 shown in FIG. 3. Other components are identical to those shown in FIG. 3.

Referring to FIG. 4, the circuit 298 for measuring the distance between light-emitting cells measures for each sub-field SF1-SF15 the distance from each pixel cell to the pixel cell in the light emission mode state that is located in the position closest thereto (within one display line) based on the pixel drive data GDD,-GDDm of each display line. For example, when the pixel drive data $GDD_1$-$GDD_m$ have logical levels as shown in FIG. 5, the pixel cells of the first column are set to a light-emission mode in the sub-field SF1 because the first bit B1 of the pixel drive data $GDD_1$ is a logical level 1. At this time, both the second bit B2 and the third bit B3 of the pixel drive data $GDD_1$ corresponding to each image cell of the second column adjacent to the pixel cells of the first column and the third column are a logical level 0, but the fourth bit B4 of the pixel drive data $GDD_1$ corresponding to the image cell of the fourth column is a logical level 1. In other words, in the sub-field SF1, the pixel cell in the light emission mode state that is located in the position closest to the pixel cell of the first column becomes the pixel cell of the fourth column. As a result, in the sub-field SF1, with respect to the pixel cell of the first column, the distance "3" from this pixel cell of the first column to the pixel cell of the fourth column will be measured by the circuit 298 for measuring the distance between light-emitting cells. Further, in the sub-field SF1, with respect to the pixel cell of the second column, the pixel cell in the light emission mode state that is located in the closest position becomes the pixel cell of the first column and, therefore, the distance "1" from this pixel cell of the second column to the pixel cell of the first column will be measured by the circuit 298 for measuring the distance between light-emitting cells. Furthermore, in the sub-field SF2, with respect to the pixel cell of the first column, the pixel cell in the light emission mode state that is located in the closest position becomes the pixel cell of the fifth column and, therefore, the distance "4" from this pixel cell of the first column to the pixel cell of the fifth column will measured by the circuit 298 for measuring the distance between light-emitting cells.

The circuit 298 for measuring the distance between light-emitting cells measures the distance to the light-emitting pixel cell located in the closest position in the same display line for each pixel cell correspondingly to each sub-field SF1-SF15 and supplies the data LD indicating the distance between the light-emitting cells to the SF correction coefficient generation circuit 299.

The SF correction coefficient generation circuit 299 finds the SF correction coefficients SG1-SG15 having values according to the data LD relating to the distance between the light-emitting cells that correspond to each sub-field SF1-SF15 for each pixel cell and supplies those SF correction coefficients to the pixel correction coefficient computation circuit.

With such a configuration, in the luminance correction circuit 29 shown in FIG. 4, video signals corresponding to each pixel are corrected for the pixels based on the mutual arrangement of the pixel cells assuming the light emission state in each display line.

As a result, the difference in luminance not only between the display lines but also between the pixel cells in a display line can be eliminated. This application is based on a Japanese patent application No. 2004-065578 which is hereby incorporated by reference.

What is claimed is:

1. A display device comprising:

a plasma display panel having formed therein a plurality of pixel cells corresponding to pixels on each of n (n is an integer more than two) display lines extended in the horizontal direction, said display device further comprising:

load magnitude measurement portion for measuring a load magnitude of an N-th (N is an integer given by $1 \leqq N \leqq n$) display line corresponding to the light emission state of each pixel cell on said N-th display line based on a video signal;

correction portion for correcting luminance level of the video signal of said N-th display line in accordance with the load magnitude of said N-th display line measured by said load magnitude measurement portion; and light emission drive portion for causing each said pixel cell to emit light by applying a sustain pulse to each said display line in accordance with the video signal corrected by said correction portion, wherein said correction portion conducts the correction so as to decrease significantly the luminance level of the video signal as said load magnitude decreases.

2. The display device according to claim 1, wherein said load magnitude measurement portion obtains said load magnitude based on the number of said pixel cells that are in the light emission state on said N-th display line.

* * * * *